US006862829B2

(12) United States Patent
McMoore

(10) Patent No.: US 6,862,829 B2
(45) Date of Patent: Mar. 8, 2005

(54) TACTILE TRIGGER FINGER SAFETY CUE FOR FIREARM OR OTHER TRIGGER-ACTIVATED DEVICE

(76) Inventor: William A. McMoore, 4203 Fairway Cir., Port Orchard, WA (US) 98367

( * ) Notice: Subject to any disclaimer, the term of this patent is extended or adjusted under 35 U.S.C. 154(b) by 300 days.

(21) Appl. No.: 09/756,632

(22) Filed: Jan. 5, 2001

(65) Prior Publication Data

US 2004/0216348 A1 Nov. 4, 2004

(51) Int. Cl.[7] ..... F41A 17/00
(52) U.S. Cl. ..... 42/70.07
(58) Field of Search ..... 42/71.02, 70.07, 42/70.01; D22/104

(56) References Cited

U.S. PATENT DOCUMENTS

| | | | | | |
|---|---|---|---|---|---|
| 1,866,202 | A | * | 7/1932 | Floyd | 42/22 |
| 3,488,488 | A | * | 1/1970 | Crouch | 42/146 |
| 3,512,290 | A | * | 5/1970 | Violette | 42/75.01 |
| 3,631,621 | A | * | 1/1972 | Tito | 42/17 |
| 3,696,706 | A | * | 10/1972 | Seidel et al. | 42/71.02 |
| 3,999,533 | A | * | 12/1976 | Buckner | 124/67 |
| 4,116,193 | A | * | 9/1978 | Chiba | 124/72 |
| 4,359,999 | A | * | 11/1982 | Garofalo | 124/22 |
| 4,563,937 | A | * | 1/1986 | White | 89/185 |
| 4,601,123 | A | * | 7/1986 | Swearengen et al. | 42/72 |
| 4,677,781 | A | * | 7/1987 | Lee | 42/70.01 |
| 5,293,708 | A | * | 3/1994 | Strayer et al. | 42/7 |
| 5,406,731 | A | * | 4/1995 | Stevens | |
| D377,513 | S | * | 1/1997 | Lenkarski et al. | |
| 5,655,326 | A | * | 8/1997 | Levavi et al. | 42/70.01 |
| 5,669,169 | A | * | 9/1997 | Schmitter et al. | |
| 5,924,231 | A | * | 7/1999 | Kidd | 42/69.03 |
| 6,173,518 | B1 | * | 1/2001 | Oberst | 42/70.06 |
| 6,354,033 | B1 | * | 3/2002 | Findley | 42/70.01 |
| 6,550,176 | B2 | * | 4/2003 | Beretta | 42/70.11 |

OTHER PUBLICATIONS

Ruger 10/22 General Info., May 2001.*
Firearm Function Testing Aug. 2000.*
O.F. Mossberg: Maverick Arms, May 1998.*
SCG Trigger, Feb. 2001.*
NRA Gun Safety Rules, Larry and Bonnie Arnold, 096/26/1998.*

* cited by examiner

*Primary Examiner*—Jack Keith
*Assistant Examiner*—Troy Chambers
(74) *Attorney, Agent, or Firm*—Glenn D. Bellamy; Greenebaum Doll & McDonald PLLC

(57) ABSTRACT

Disclosed is a tactile cue which provides a safety reminder to the user of a firearm or other trigger-activated device. A tactile stimulus, preferably either an indentation or protrusion, is positioned on the firearm or other device where the user's finger should rest, off the trigger, until the firearm or other device is "on target" and pulling the trigger is appropriate. In preferred form, the tactile cue is placed on one or both sides of a trigger guard or if no trigger guard is present, on the frame or body of the firearm or other device.

4 Claims, 2 Drawing Sheets

TACTILE TRIGGER FINGER SAFETY CUE FOR FIREARM OR OTHER TRIGGER-ACTIVATED DEVICE

TECHNICAL FIELD

This invention relates to a safety device for firearms, or any other type of tool or weapon, which are activated by a trigger. The invention provides a safety reminder in the form of a tactile cue which can be felt by the user's trigger finger when the finger is in a "safe" or "off trigger" position. The tactile cue provides a reminder to the user to keep the trigger finger in the safe position, i.e., off of the trigger, until the weapon or device "is on target."

BACKGROUND

It is a basic tenant of firearm safety that one should never point a gun at anything or anyone which they do not intend to shoot. As an additional measure, in order to prevent accidental discharges, one should not place their finger on the trigger until the gun is pointed at the chosen target and the user is ready to shoot, i.e. the gun is "on target." These rules of safety apply not only to firearms and other types of guns, but also to trigger-activated tools, such as electric or pneumatic nail guns.

It may take considerable time and practice for one to acquire the habit of always keeping the trigger finger in the "safe" position. This problem is especially prominent among those new to the use of firearms or other trigger-operated devices. Previously, there has not been a means for reminding the user to maintain this safe practice other than the presence of an instructor or partner.

SUMMARY OF INVENTION

The present invention provides a tactile cue as a means to remind the user that the trigger finger is to be kept in a "safe" position, i.e., off of the trigger, until ready to fire. The present invention is embodied in the form of a notch, indentation, dimple, bump, protrusion or protuberance positioned such that it provides a tactile stimulus to the user's trigger finger when the finger is in the "safe" position. This tactile stimulus means or device may be positioned on the firearm or device's trigger guard or on another appropriate position on the frame of the gun or the body of the tool. The stimulus means is easily formed as a depression (absence of material) or as a protrusion (addition of material).

In preferred form, the tactile stimulus means positioned such that it would stimulate the more sensitive tip portion of the trigger finger. Also, if desired, the tactile stimulus means may be applied on both sides of the trigger guard or device such that the safety cue will function ambidextrously.

BRIEF DESCRIPTION OF THE DRAWING

Like reference numerals are used to indicate like parts throughout the various figures of the drawing, wherein.

PREFERRED MODE OF CARRYING OUT THE INVENTION

The present invention may be embodied in many forms and may be put to use on many different devices. As described in the summary of the invention, the tactile stimulus means itself maybe embodied either as a depression or a protrusion properly positioned on the device to stimulate, i.e., be felt by, the user's trigger finger when it is in the "safe" position. Although the preferred embodiment described below relates to a handgun, the invention may be employed on any type of firearm or gun, either with or without a trigger guard. Likewise, this safety device may be employed on trigger-operated tools such as staple guns or nail guns. As used herein, "firearm" is intended to encompass all of the above-described devices.

Figure 1:
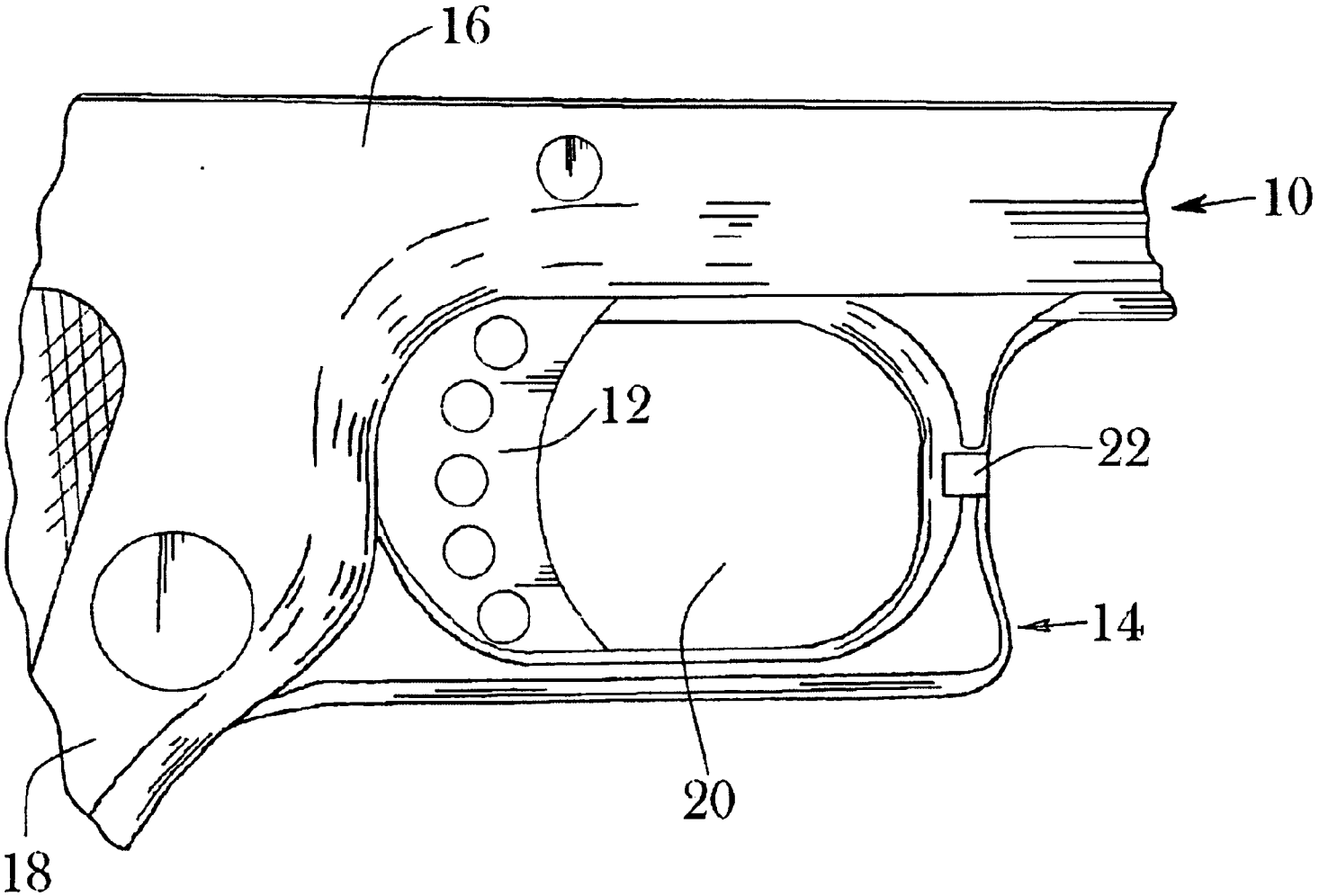
FIG. 1 is a close-up, fragmentary view of a trigger guard that includes the present invention.

Referring now to FIG. 1, therein is shown at 10 a portion of a firearm with particular focus on the trigger (12) and trigger guard (14) portion. Generally, the firearm (10) includes a frame (16) with a grip portion (18). The trigger guard (14) creates an opening (20) into which one's trigger finger must be inserted in order to engage and press the trigger (12).

The present invention is shown in FIG. 1 in the form of a groove or notch (22) formed on lateral slides of a forward portion of the trigger guard (14). In practice, the tactile stimulating notch (22) need only be 1/32–1/16 inch in depth in order to be detected by the very sensitive tip of a user's forefinger. Likewise, a bump or ridge of similar height could be substituted for the groove (22) in this position.

Figure 2:
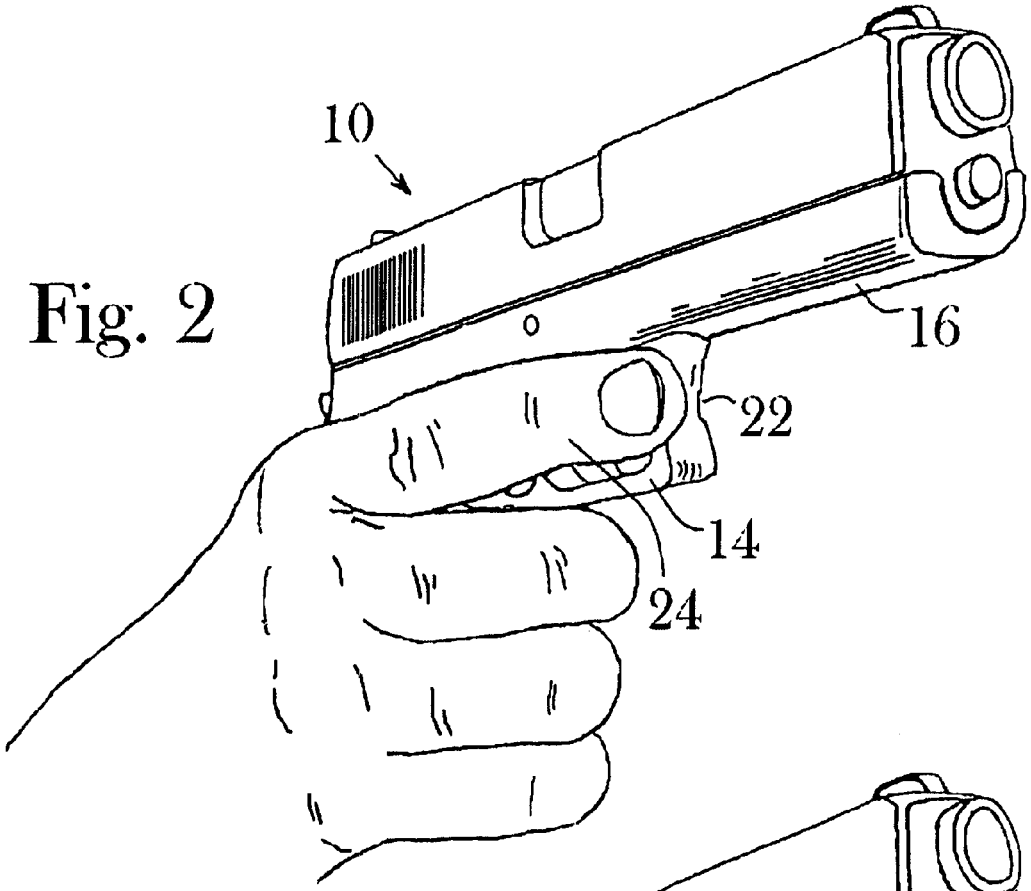
FIG. 2 is a pictorial view of a handgun wherein the user's trigger finger is in the "safe" position and overlies the tactile stimulus means on the trigger guard.
Figure 3:
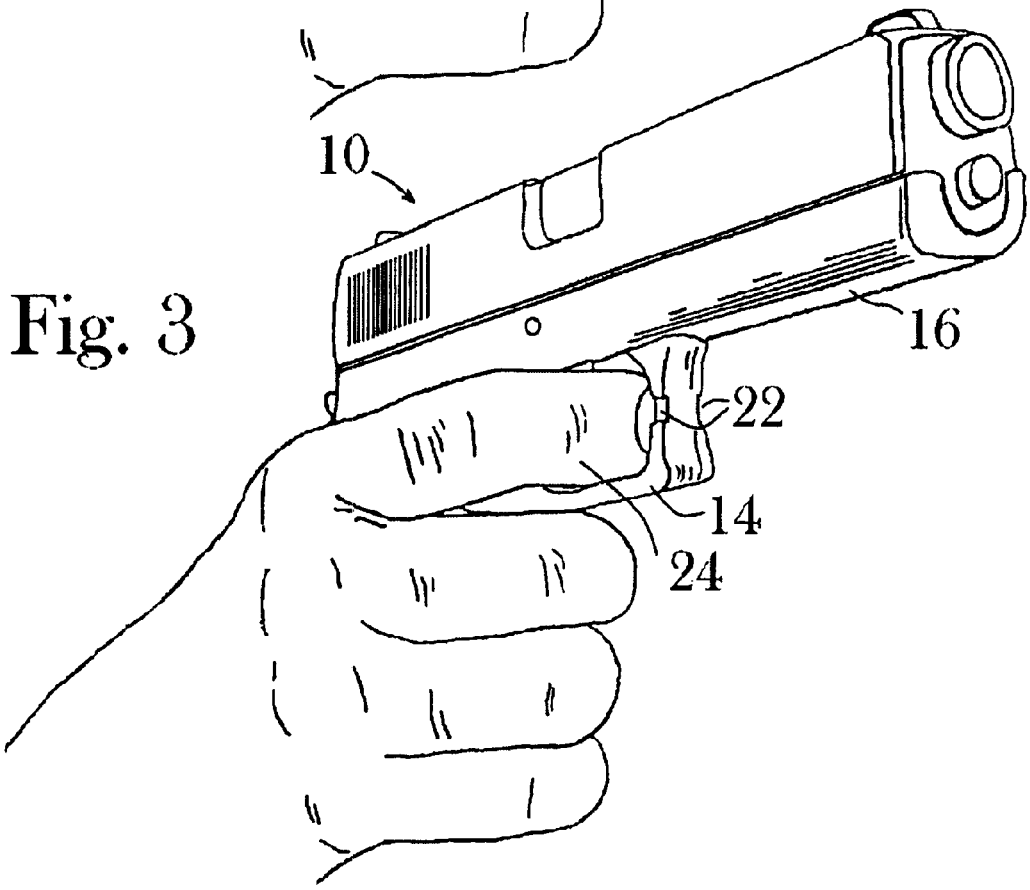
FIG. 3 is a pictorial view substantially like FIG. 2 in which the trigger finger has been moved to the "on target," ready-to-fire position on the trigger.

Referring now to FIGS. 2 and 3, therein are shown pictorial views of a semi-automatic hand gun held by a user in which the trigger finger is in the "safe" position and "on target," ready-to-fire position, respectively. As shown in FIG. 2, the sensitive, forward portion of the user's forefinger (trigger finger) (24) lies directly on the tactile stimulating reminder notch (22) or cue when the trigger finger is in the proper "safe" position. It can be seen in both FIGS. 2 and 3, that applying the notch (22) or other cue means to both lateral sides of the trigger guard 14 allows the invention to function and ambidextrously. FIG. 3 shows the trigger finger (24) moved onto the trigger and to the "on target" or ready-to-fire position. By viewing FIGS. 2 and 3, it can readily be seen that this invention may be retrofitted to existing devices and firearms as well as designed into new products without detracting in any way from the form, function or appearance of the firearm or other device.

Some firearms or other trigger-activated devices do not have a trigger guard (14) as shown in FIGS. 1–3. In such case, or even in the presence of a trigger guard, a notch, groove or protrusion may be situated on the frame (16) of the firearm (10) or other device in alignment with where the trigger finger (24) would rest when in the "safe" position.

The embodiment of the present invention shown and described herein is that which is preferred by the inventor at the present time. It is to be understood that many variations and modifications could be made without departing from the spirit and scope of the present invention. Therefore, my patent protection is to be defined only be the following claim or claims, properly and legally construed, including by use of the doctrine of equivalence and reversal of parts.

What I claim is:

1. A method for avoiding accidental discharge of a firearm or other trigger-activated device having a trigger guard, comprising:

determining a "safe" position for a user of the firearm to place the user's trigger finger while gripping the firearm for use, the position being off of the trigger and on a forward portion of the trigger guard with the trigger finger forwardly-extended such that it can be moved onto the trigger without adjusting the user's grip;

providing at least one tactile stimulating surface cue positioned laterally and situated on at least one side of a forward portion of the trigger guard;

positioning the cue to provide a stimulus to a user's trigger finger when the firearm is gripped with the user's hand and the trigger finger is in the determined forwardly-extended "safe" position off of the firearm's trigger;

gripping the firearm for use with at least one of the user's hands in a manner that allows the trigger finger to be moved, without changing the user's grip, between a first "safe" position off of the trigger and extended forwardly to rest on a corresponding side of a forward portion of the trigger guard on the tactile stimulating surface cue and a second position on a finger-contacting portion of the trigger; and intentionally using the stimulus of the tactile stimulating surface cue as a reminder to keep the trigger finger in the determined "safe" position until ready to move the trigger finger onto the trigger for an "on target," ready-to-fire position.

2. The method of claim 1, wherein at least one tactile stimulating surface cue includes a notch.

3. The method of claim 1, wherein at least one tactile stimulating surface cue includes a protrusion.

4. The method of claim 1, further providing a pair of tactile stimulating surface cues positioned at substantially symmetrical positions on opposite sides of the firearm so as to provide the tactile stimulus ambidextrously.

* * * * *